US005742941A

United States Patent [19]

Porter

[11] Patent Number: 5,742,941

[45] Date of Patent: Apr. 28, 1998

[54] GOLF GLOVE

[76] Inventor: Michael Porter, 26252 N. 43rd Pl., Phoenix, Ariz. 85024

[21] Appl. No.: 588,633

[22] Filed: Jan. 19, 1996

[51] Int. Cl.[6] ..... A41D 19/00

[52] U.S. Cl. ..... 2/161.4; 2/917

[58] Field of Search ..... 2/160, 161.1, 161.2, 2/161.3, 161.4, 917

[56] References Cited

U.S. PATENT DOCUMENTS

| | | | |
|---|---|---|---|
| 2,751,598 | 6/1956 | Romeo | 2/161.3 |
| 2,852,779 | 9/1958 | Roessler | 2/161.1 |
| 3,105,972 | 10/1963 | Christopher | 2/161.2 |
| 3,274,616 | 9/1966 | Russo | 2/161.3 |
| 3,348,238 | 10/1967 | Hydock | 2/161.2 |
| 3,559,212 | 2/1971 | Skovron | 2/161.4 |
| 3,918,097 | 11/1975 | Mlodoch | 2/161.1 |
| 5,033,120 | 7/1991 | Myers | 2/161.2 |
| 5,088,122 | 2/1992 | O'Toole | 2/161.4 |
| 5,414,868 | 5/1995 | Crawford | 2/161.2 |
| 5,435,013 | 7/1995 | Davis | 2/161.1 |

FOREIGN PATENT DOCUMENTS

| | | | |
|---|---|---|---|
| 6079029 | 3/1994 | Japan | 2/161.2 |

*Primary Examiner*—Michael A. Neas

*Attorney, Agent, or Firm*—Donald J. Lenkszus; O'Connor Cavanagh

[57] ABSTRACT

A golf glove adapted to assist in maintaining a proper grip on the club by means of an elastic strap affixed to the back of the glove which may be drawn around the hand and golf club handle and fastened to the backhand portion of the fourth and fifth fingers of the hand.

14 Claims, 5 Drawing Sheets

GOLF GLOVE

FIELD OF THE INVENTION

This invention relates to golf gloves, and more particularly to a golf gloves that ensures that a proper grip is maintained.

BACKGROUND OF INVENTION

In the game of golf, a golfer attempts to hit a golf ball in a desired direction with a golf club. In order to hit the ball in the desired direction, the golfer must first, swing the head of the club along a path parallel to the desired direction and second, keep the club face in a perpendicular orientation with respect to the desired direction. If the club face is not perpendicular to the line of travel, the impact of the club face on the ball will impart a spin to the ball. If the club face is turned away from the golfer, the spin will create a "slice" where the ball curves away from the golfer. If the club face is turned toward the golfer, the spin will create a "hook" where the ball curves toward the golfer. In either case, such curvature in the ball's path is generally undesirable.

In order to prevent a hook or slice the golfer must maintain a proper grip on the club. The traditional right-handed grip places the left hand at the uppermost end of the club handle with the right hand placed immediately below the left hand. The left-handed grip reverses the positioning of the hands.

It is conventional wisdom that the fourth and fifth fingers of the upper hand are critical in maintaining a proper grip. If these fingers do not firmly grip the uppermost portion of the club handle the club face tends to "open" or angle away from the golfer, thus creating an undesirable slice. The lack of a firm grip may have many causes ranging from physical disability (including a loss of one or more fingers) to improper training. It is therefore desirable to create an aid that compensates for physical disability or assists in proper training by providing assistance to the golfer in maintaining a proper grip with the fourth and fifth fingers of the upper hand.

RELEVANT ART

There are numerous examples of golf gloves that have been adapted to assist the golfer in maintaining a proper grip. For example, U.S. Pat. No. 5,033,120 issued to Myers teaches a glove with a flap attached to the base of the thumb which attaches to the tips of the fourth and fifth fingers of the hand, thereby restraining those fingers firmly around the golf club handle. In a similar vein, U.S. Pat. Nos. 3,105,972 issued to Christopher, 3,274,616 issued to Russo, 3,348,238 issued to Hydock, 3,918,097 issued to Mlodoch, and 5,088,122 to O'Toole all teach the idea of using a strap which wraps around the hand and golf club handle to force the fingers into a proper grip.

These structures have a number of problems. First, some of these structures, such as Mlodoch and Myers, apply the holding force to the tips of the fingers. This has a tendency to apply inadequate pressure to the grip. In contrast, other approaches, such as Russo, encircle the entire hand, or at least the third, fourth and fifth fingers, rather than just the fourth and fifth. Securing the third finger is generally unnecessary, as its contribution to the proper grip is less critical than that of the fourth and fifth fingers.

Second, many of these structures, such as Myers, Hydock and Christopher, use a reinforcing strap that is affixed to the glove at a location at the base of the thumb. This creates a host of problems, including interference with the grip when the strap is not in use and additional complexity in the manufacture of the glove. O'Toole resolves the interference problem by moving the attach point to the back of the hand across the knuckles of the third, fourth and fifth fingers. This does not resolve the issue of manufacturing complexity. Russo provides an independent reinforcing strap. While this simplifies manufacture and eliminates interference problems, it creates a new problem, i.e., the inconvenience of having a two-part glove.

OBJECTS OF THE INVENTION

Accordingly, it is one object of the invention to provide a golf glove that assists the golfer in maintaining a proper grip on the golf club.

Another object of the invention to provide a golf glove that assists physically impaired golfers in maintaining a proper grip on the golf club.

It is a further object of the invention to provide a grip assist golf glove where the mechanism for assisting a proper grip does not interfere with the golfer's grip when the mechanism is not in use.

It is yet another object of the invention to provide a grip assist golf glove that can be easily manufactured with existing manufacturing techniques and tools.

These and other objects of the invention are achieved in a golf glove in accordance with the invention.

SUMMARY OF THE INVENTION

The golf glove of the present invention includes a golf glove of standard construction made up of a palm portion and a backhand portion forming a handpocket therebetween, a thumb opening and finger openings. Each of the palm and backhand portions include extensions defining thumb and finger pockets. The backhand portion is split in a conventional manner to allow the hand to be easily inserted and withdrawn. Along one edge of the split, an adjustment strap is attached. A means for attaching the adjustment strap to the backhand portion on the opposite side of the split is provided so that the adjustment strap may drawn across the split and attached to the backhand portion thereby securing the glove more snugly to the hand.

In accordance with the principles of the invention, a grip reinforcement strap is affixed to the adjustment strap. A fastener is attached to the end of the grip reinforcement strap. Fastener are also attached to the backhand portion of the glove at about the beginning fingerholes for the fourth and fifth fingers and extending to the second knuckle of those fingers. The golfer puts on the glove and adjusts it by means of the adjustment strap so that it fits snugly. The golfer then properly positions his hand around the golf club handle and then draws the grip reinforcement strap around the base of the thumb and over the fourth and fifth fingers and attaches it by means of the fasteners to those fingers.

When not in use, the grip reinforcement strap can be folded over on the back of the hand and held in place by additional fasteners mounted on the grip reinforcement strap and the backhand portion of the glove.

BRIEF DESCRIPTION OF THE DRAWINGS

The present invention will be better understood from a reading of the following detailed description taken in conjunction with the following drawing in which like referenced designations indicate like elements and in which.

DETAILED DESCRIPTION OF THE PREFERRED EMBODIMENT

Figure 1:
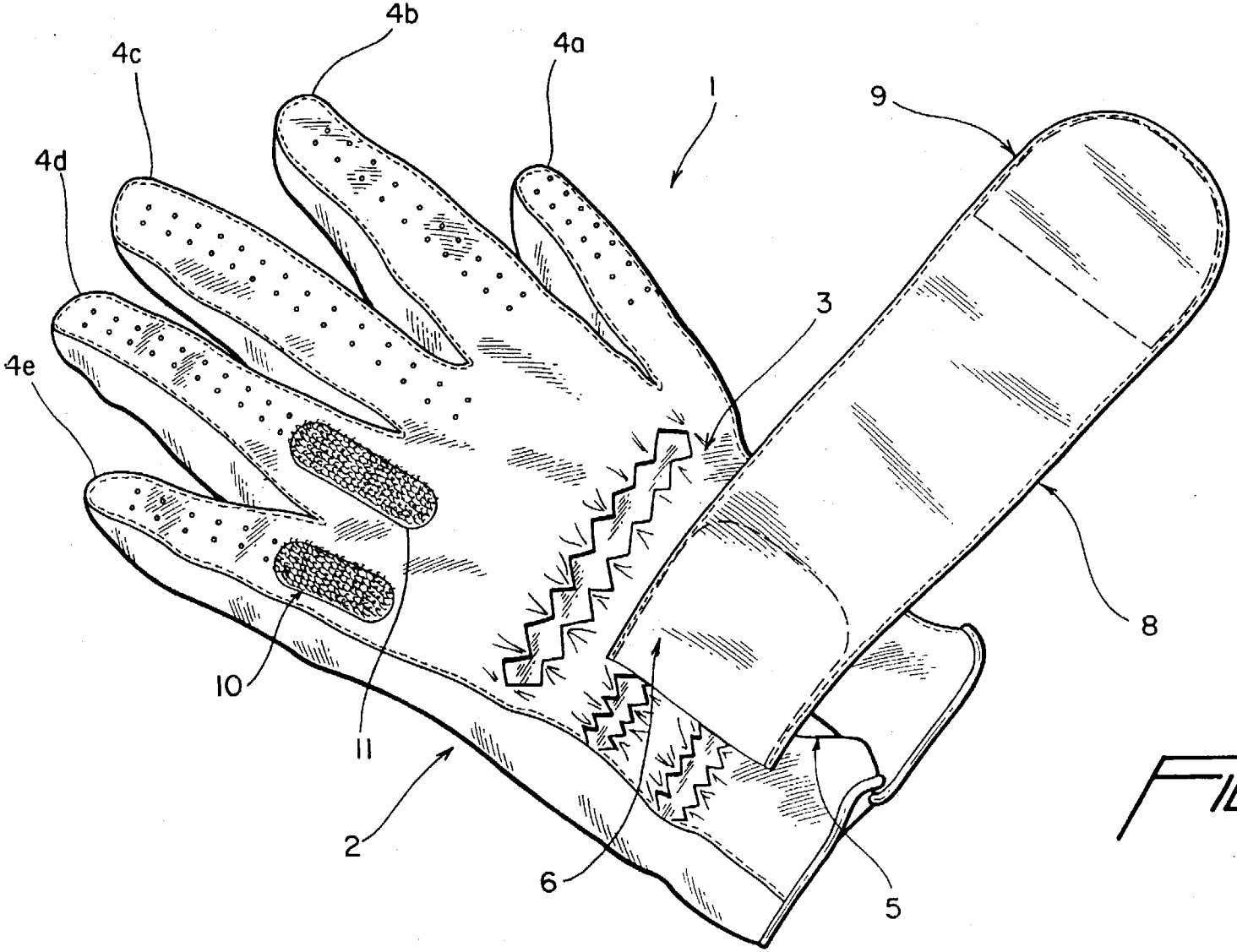
FIG. 1 is a view of the backhand side of the glove.
Figure 3:
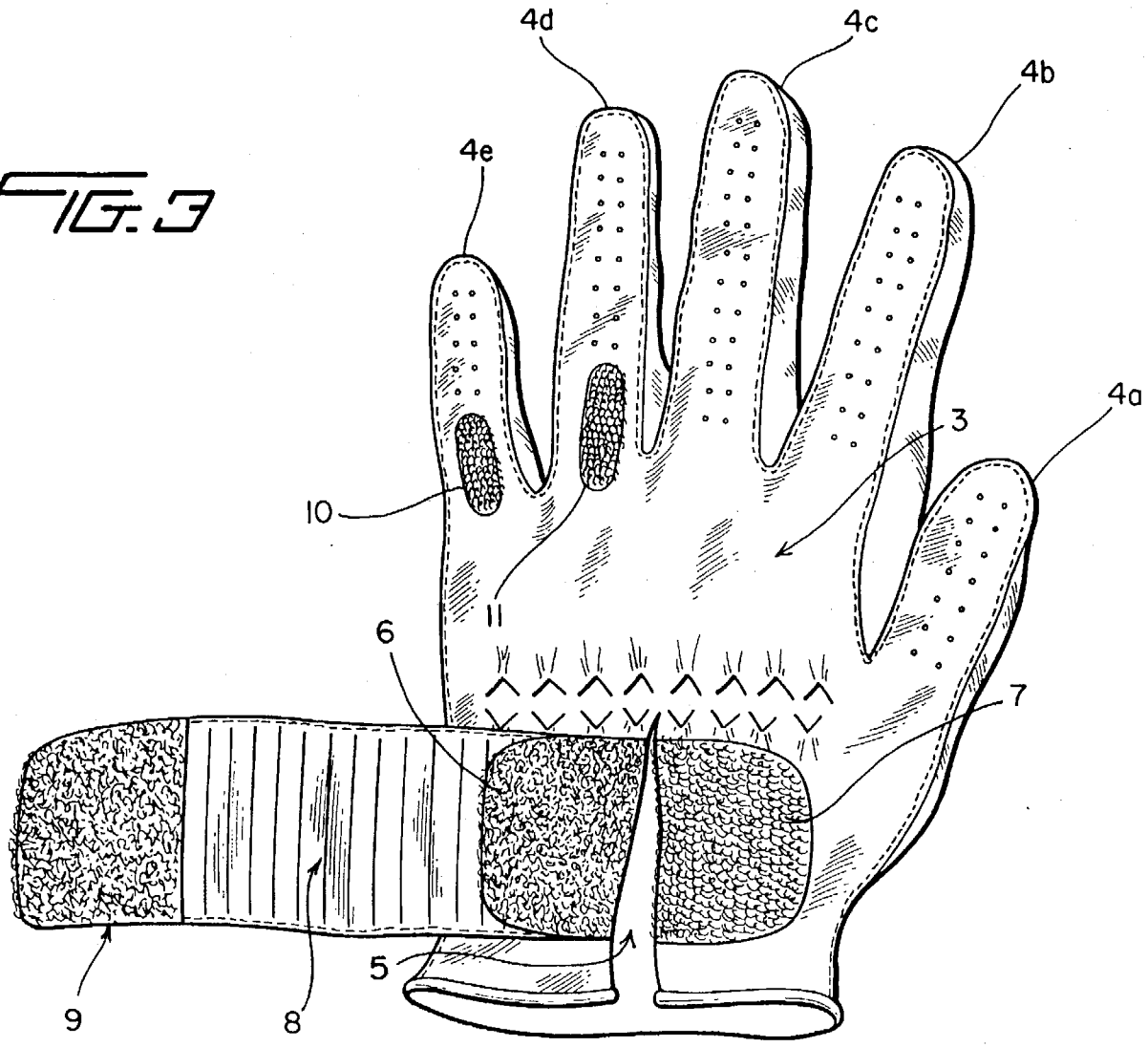
FIG. 3 is a view of the backhand side of the glove with the grip reinforcing strap pulled aside.

As seen in FIG. 1, the golf glove of the present invention includes a golf glove 1 of standard construction made up of a palm portion 2 (not visible) and a backhand portion 3 forming a handpocket therebetween, a thumb opening and finger openings. Each of the palm and backhand portions include extensions defining thumb and finger pockets 4*a*, 4*b*, 4*c*, 4*d* and 4*e*. As can be seen in FIG. 3, the backhand portion 3 has a split 5 which allows the hand to be easily inserted and withdrawn. Along one edge of the split 5, an adjustment strap 6 is attached. A fastener 7 for attaching the adjustment strap 6 to the backhand portion 3 on the opposite side of the split 5 is provided so that the adjustment strap 6 may drawn across the split 5 and attached to the backhand portion 3 thereby securing the glove more snugly to the hand.

Figure 6:
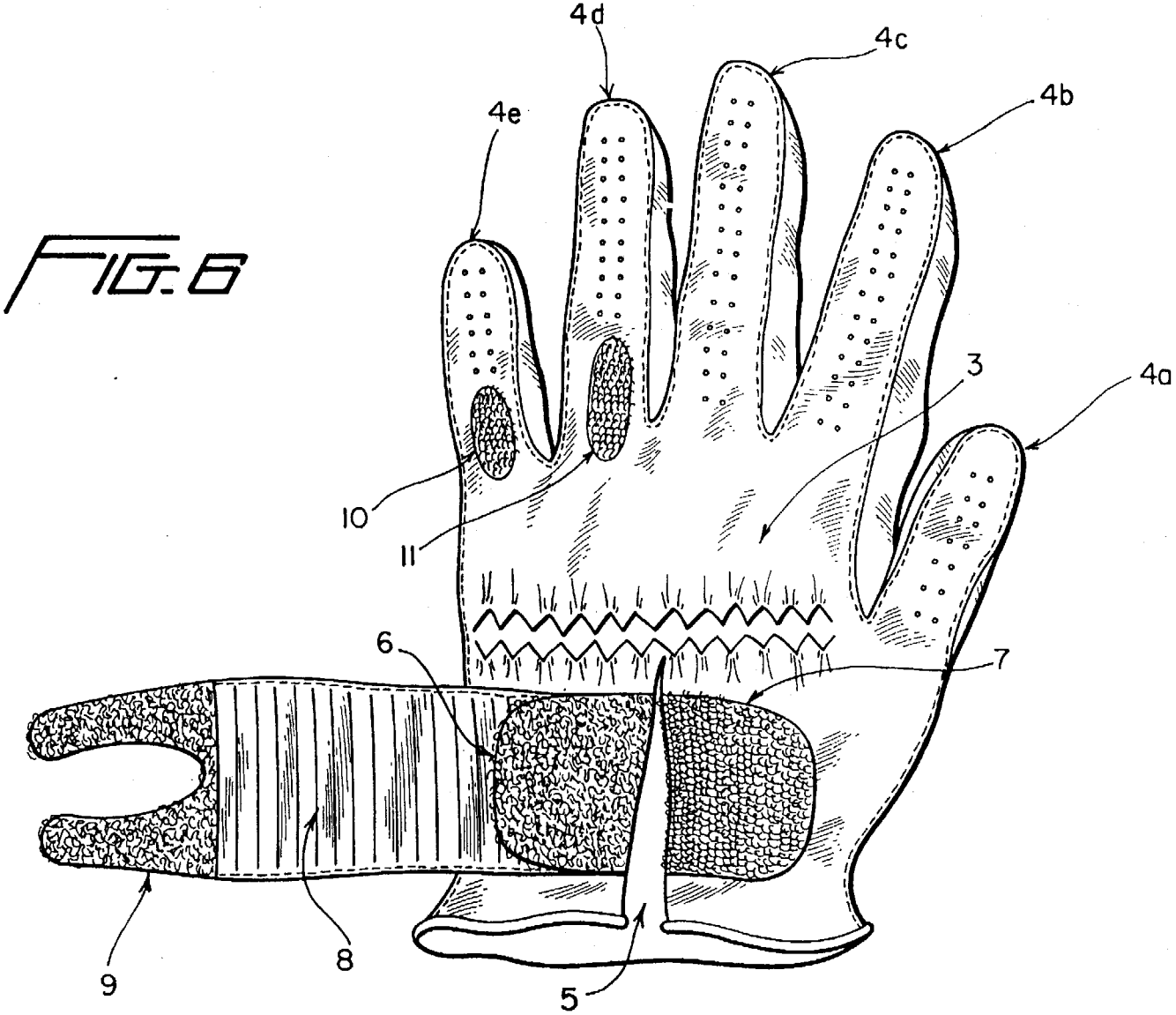
FIG. 6 is a view of the glove showing the split fastener embodiment.

A grip reinforcement strap 8 is affixed to the adjustment strap 6. The grip reinforcement strap may be made of an elastic material. This allows the grip reinforcement strap 8 to be drawn snugly across the hand and provide additional securing force to assist the grip. A fastener 9 is attached to the end of the grip reinforcement strap 8. In one embodiment, as in FIG. 3, the fastener 9 is substantially unitary. In another embodiment, as in FIG. 6, the fastener 9 is split into two segments to provide independent mobility and flexure of the fourth and fifth fingers. In an alternative embodiment, the adjustment strap 6, the grip reinforcement strap 8 and the fastener 9 may be a unitary piece with fasteners attached to achieve the same effect as the multi piece structure.

Figure 2:
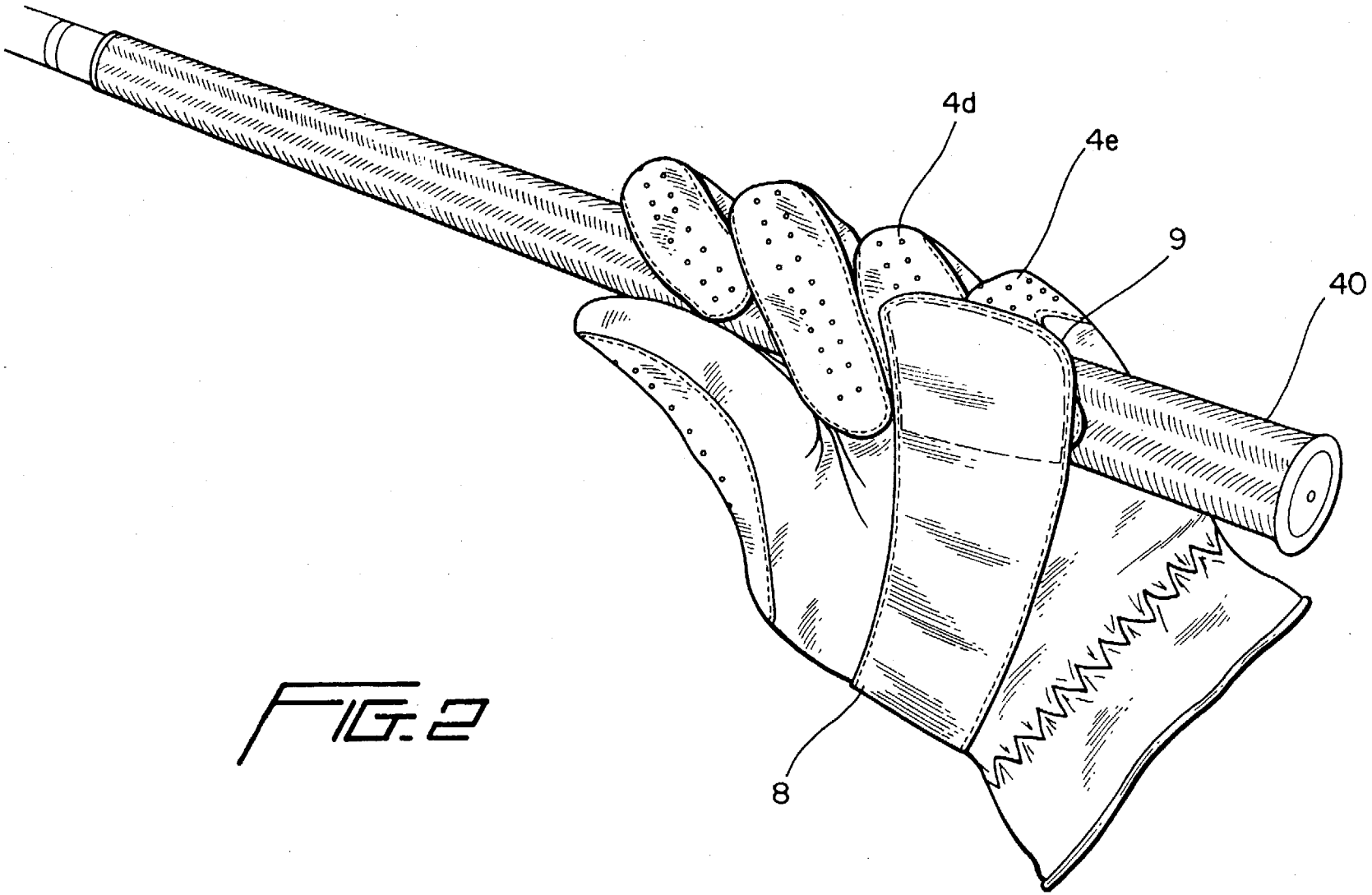
FIG. 2 is a view of the glove in use, when gripping a club.

Fasteners 10 and 11 are also attached to the backhand portion 3 of the glove at a about beginning fingerholes for the fourth and fifth fingers 4*d*, 4*e* and extending to the second knuckle of those fingers. The golfer puts on the glove and adjusts it by means of the adjustment strap so that it fits snugly. As shown in FIG. 2, the golfer then properly positions his hand around the golf club handle 40 and then draws the grip reinforcement strap 8 around the base of the thumb and over the fourth and fifth fingers 4*d*, 4*e* and attaches it by means of the fasteners 9, 10, 11 (10 and 11 hidden beneath 9) to those fingers.

Figure 4:
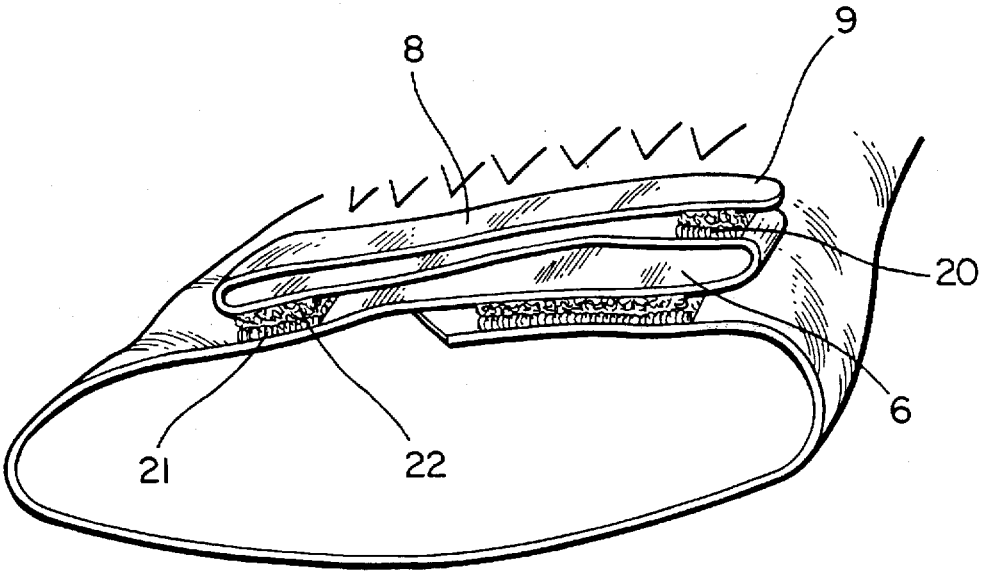
FIG. 4 is a view of the glove showing the first storage embodiment.

When not in use, the grip reinforcement strap can be folded over on the back of the hand and held in place by additional fasteners mounted on the grip reinforcement strap and the backhand portion of the glove. In one embodiment, as shown in FIG. 4, the grip reinforcement strap 8 can be folded back across the adjustment strap 6 and held down by a first stowage fastener 21, 22. The remaining loose length of the grip reinforcement strap can be folded back again and attached to the glove by the fasteners 9 and a second stowage fastener 20.

Figure 5:
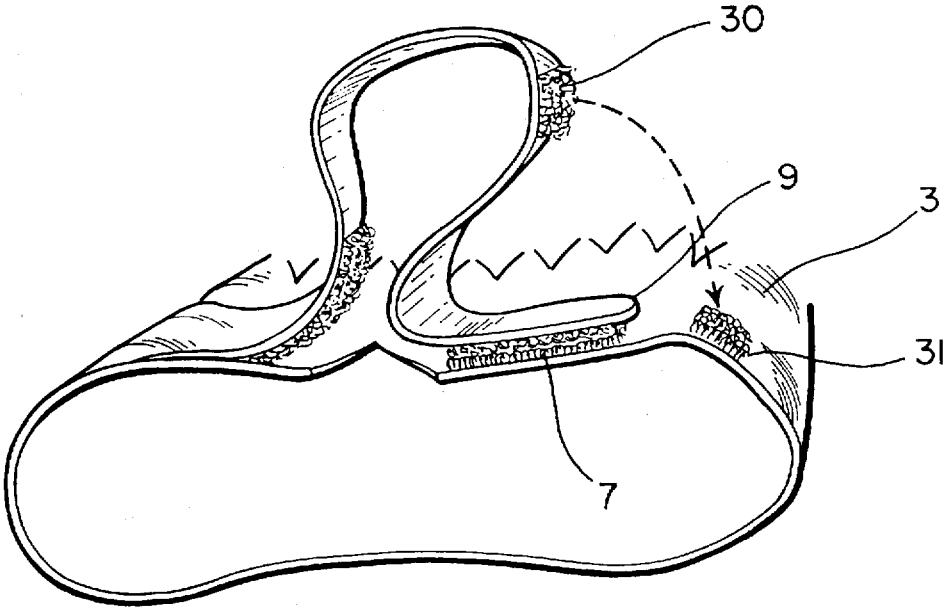
FIG. 5 is a view of the glove showing the second storage embodiment.

As shown in FIG. 5, in another embodiment, the grip fastener 9 can be applied to the adjustment fastener 7. The excess length will create a loop across the split. This loop can be drawn down (as shown by broken arrow) and fastened to the backhand portion 3 by means of a stowage fastener 30, 31.

In either case, stowage of the grip reinforcement strap 8 across the backhand portion 3 of the glove 1 will allow the glove 1 to be used without the grip assist, such as during putting. By positioning the grip reinforcement strap 8 on the backhand portion 3 of the glove 1, the grip enforcement strap 8, while stored, does not interfere with the gripping of the club.

The various fasteners referred to above can take any conventional form, such as buttons or snaps. The preferred method, however is to use hook and loop type nylon fasteners commonly known as Velcro. Velcro fasteners have two complimentary components, the hook side comprising a plurality of small nylon hooks and the loop side comprising a plurality of small nylon loops, wherein said hooks engage said loops when the components are brought into contact.

A significant advantage of this invention is that the glove can be manufacture with a minimum of modifications to existing glove manufacturing processes. There are no changes whatsoever to the basic structure of the glove. In fact, the only additions are the placement of the finger fasteners and the grip reinforcement strap. Both of these elements can easily be sewn on to existing gloves once they have been fabricated.

Although certain preferred embodiments and methods have been disclosed herein, it will be apparent from the foregoing disclosure to those skilled in the art that variations and modifications of such embodiments and methods may be made without departing from the true spirit and scope of the invention. Accordingly, it is intended that the invention shall be limited only to the extent required by the appended claims and the rules and principles of applicable law.

I claim:

1. A golf glove, comprising:

a glove body having a palm portion and a backhand therebetween a handpocket, a thumb opening and a plurality of finger openings, wherein one of said finger openings is a ring finger opening;

wherein said palm portion and said backhand portion extensions forming a thumb pocket and a plurality of finger pockets each having a side and a backhand side, wherein one of said finger pockets is a ring finger pocket;

a single grip reinforcement strap having a glove end, said glove end being affixed to said backhand portion;

a first fastener affixed to said free end;

a second fastener disposed on said backhand side of said ring finger pocket on the portion of said ring finger pocket disposed so as to be positioned between the outermost joint of a ring finger and said hand pocket; said strap being wrappable around said glove from said backhand portion across said palm portion in the area if the base of said thumb pocket to said second fastener such that said first fastener engages said second fastener;

a first stowage fastening means attached to one side of said grip reinforcement strap;

a second stowage fastening means attached to said backhand portion; and a third stowage fastening means attached to the other side of said grip reinforcement strap, wherein said first stowage fastening means engages said second stowage fastening means and said third stowage fastening means engages said first fastener to secure said grip reinforcement strap in a stowed position.

2. The apparatus of claim 1, wherein said grip reinforcement strap is elastic.

3. The golf glove of claim 1, further comprising:

a third fastener attached to the backhand side of a second of said finger pockets to engage said first fastener.

4. The golf glove of claim 3 wherein said first fastener and said free end are substantially unitary.

5. The golf glove of claim 3 wherein said first fastener is comprises into two segments, wherein one segment engages said second fastener and the other segment engages said third fastener.

6. The apparatus of claim 4 wherein said first fastener comprises one of a hook or loop component of a hook and loop type fastener and said second and third fasteners each comprises the complimentary component hook or loop component of said hook and loop type fastener.

7. The apparatus of claim 5 wherein each of said two segments of said first fastener comprises one of a hook or loop component of a hook and loop type fastener and said second and third fasteners each comprises the complimentary component hook or loop component of said hook and loop type fastener.

8. A golf glove, comprising:

a glove body having a palm portion and a backhand portion defining therebetween a handpocket, a thumb opening and a plurality of finger openings, wherein said backhand portion has a split therein;

an adjustment strap fastened to the backhand portion on one side of said split;

a fastening means for engaging said adjustment stray affixed to the backhand portion on the other side of said split;

wherein said palm portion and said backhand portion have extensions forming a thumb pocket and a plurality of finger pockets each having a palm side and a backhand side;

a single grip reinforcement strip means having a glove end and a free end, said glove end being affixed to said adjustment strap;

a first fastener affixed to said free end;

a second fastener attached to the backhand side of a least one of said finger pockets for engaging said first fastener when said grip reinforcement strap is wrapped around said glove body from said backhand portion across said palm portion in the area of the base of said thumb pocket onto said at least one finger pocket;

a first stowage fastening means attached to said grip reinforcement strap;

a second stowage fastening means attached to said backhand portion; and a third stowage fastening means attached to said strap, wherein said first stowage fastening means engages said second fastening means and said third stowage fastening means engages said first fastener to reinforcement strap in a stowed position.

9. The apparatus of claim 8, wherein said grip reinforcement strap is elastic.

10. A golf glove, comprising:

a glove body having a palm portion and a backhand portion defining therebetween a handpocket, a thumb opening and a plurality of finger openings wherein said backhand portion is divided, forming a split therein, wherein said palm portion and said backhand portion have extensions forming a thumb pocket and a plurality of finger pockets each having a palm side and a backhand side;

a single strap fastened to the backhand portion on one side of said split said strap having first and second portions said first portion being elastic;

a first fastening means affixed to said first portion;

a second fastening means affixed to the backhand portion on the other side of said split and adapted to engage said first fastening means;

said second portion having a glove end and a free end, said glove end being affixed to said first portion, said second portion being elastic;

a third fastening means affixed to said free end of said second portion; and a fourth fastening means attached to the backhand side of at least one of said finger pockets, said fourth fastening means being adapted to engage said third fastening means.

11. A golf glove in accordance with claim 10, comprising:

a first stowage fastening means attached to said second portion strap; and a second stowage fastening means attached to said backhand portion, an engaged with said first stowage fastening means to secure said strap in a stowed position.

12. A golf glove in accordance with claim 10, further comprising:

a first stowage fastening means attached to said strap;

a second stowage fastening means attached to said backhand portion; and a third stowage fastening means attached to said strap, wherein said first stowage fastening means engages to said second stowage fastening means and said third stowage fastening means engages to said third fastening means to secure said strap in a stowed position.

13. A method for manufacturing a golf glove, said golf glove comprising a glove body having a palm portion and a backhand portion defining therebetween a handpocket, a thumb opening and a plurality of finger openings wherein said palm portion and said backhand portion have extensions forming a thumb and a plurality of finger pockets each having a palm side and a backhand side, wherein said backhand portion has a split therein, an adjustment strap fastened to the backhand portion on one side of said split and a fastening means corresponding to said adjustment strap affixed to the backhand portion on the other side of said split, said method comprising the steps of:

sewing a fastener to the backhand side of pocket of a golf glove;

sewing a grip reinforcement strap to the backhand portion of said golf glove; and sewing a stowage fastening means to said grip reinforcement strap.

14. The method of claim 13, further comprising the steps of:

sewing a first stowage fastening means to said grip reinforcement strap; and, sewing a second stowage fastening means to said backhand portion.

* * * * *